US012583646B2

(12) United States Patent
Dietrich et al.

(10) Patent No.: US 12,583,646 B2
(45) Date of Patent: Mar. 24, 2026

(54) SEPARATING UNIT

(71) Applicant: Weber Food Technology GmbH, Breidenbach (DE)

(72) Inventors: Andreas Dietrich, Biedenkopf (DE); Alexander Schmitt, Friedensdorf (DE); Carl Felix Moll, Netphen (DE); Rainer Doht, Borgholzhausen (DE); Tim Leicht, Burbach (DE); Philip Kahl, Frankenberg (DE)

(73) Assignee: Weber Food Technology SE & Co. KG, Breidenbach (DE)

( * ) Notice: Subject to any disclaimer, the term of this patent is extended or adjusted under 35 U.S.C. 154(b) by 0 days.

(21) Appl. No.: 18/864,050

(22) PCT Filed: Apr. 14, 2023

(86) PCT No.: PCT/EP2023/059800
§ 371 (c)(1),
(2) Date: Dec. 16, 2024

(87) PCT Pub. No.: WO2023/217487
PCT Pub. Date: Nov. 16, 2023

(65) Prior Publication Data

US 2025/0263185 A1 Aug. 21, 2025

(30) Foreign Application Priority Data

May 12, 2022 (DE) ..... 102022111940.8
Jul. 28, 2022 (DE) ..... 102022118988.0

(51) Int. Cl.
*B65B 9/04* (2006.01)
*B65B 47/02* (2006.01)
(Continued)

(52) U.S. Cl.
CPC ..... *B65B 61/02* (2013.01); *B65B 9/04* (2013.01); *B65B 47/02* (2013.01); *B65B 47/08* (2013.01); *B65B 61/06* (2013.01)

(58) Field of Classification Search
CPC ..... B65B 9/04; B65B 47/02; B65B 47/04; B65B 47/08; B65B 47/10; B65B 61/02; B65B 61/06; B65B 61/18; B65B 65/006
(Continued)

(56) References Cited

U.S. PATENT DOCUMENTS 10,065,755 B2 * 9/2018 Palumbo ..... B65B 9/04
2002/0178885 A1 12/2002 Rohrer et al.
(Continued)

FOREIGN PATENT DOCUMENTS

DE 3336660 C1 * 1/1985 ..... B26F 1/16
DE 3935625 A1 5/1991
(Continued)

OTHER PUBLICATIONS

German Patent Application 102022118988.0 Search Report issued Jul. 28, 2022.
(Continued)

*Primary Examiner* — Stephen F. Gerrity
(74) *Attorney, Agent, or Firm* — Erise IP, P.A.

(57) ABSTRACT

A separating unit for a packaging machine for packing food products is disclosed. The separating unit may be used in a molding station, a heating station, or a combined heating and molding station. The separating unit may be configured to process a material web that is moved through the packaging machine in a transport direction. The processing of the material web may be performed by a plurality of separating elements that may be of the same type or of different types to produce perforations and/or peel corner cuts in the material web.

43 Claims, 9 Drawing Sheets

(51) Int. Cl.
*B65B 47/08* (2006.01)
*B65B 61/02* (2006.01)
*B65B 61/06* (2006.01)

(58) Field of Classification Search
USPC ..... 53/453, 133.8, 559, 389.3
See application file for complete search history.

(56) References Cited

U.S. PATENT DOCUMENTS

| | | | | |
|---|---|---|---|---|
| 2004/0237474 | A1* | 12/2004 | Gregerson et al. | B65B 47/02 53/453 |
| 2007/0022717 | A1 | 2/2007 | Seggern et al. | |
| 2008/0148690 | A1 | 6/2008 | Seggern et al. | |
| 2014/0150377 | A1 | 6/2014 | Ehrmann et al. | |
| 2017/0197746 | A1 | 7/2017 | Schiche et al. | |
| 2021/0053712 | A1* | 2/2021 | Hargreaves | B65B 47/04 |
| 2023/0303285 | A1* | 9/2023 | Paul | B65B 9/04 |

FOREIGN PATENT DOCUMENTS

| | | | |
|---|---|---|---|
| DE | 19521604 | C1 | 4/1997 |
| DE | 102005035476 | A1 | 2/2007 |
| DE | 102006061309 | A1 | 7/2008 |
| DE | 102012020359 | A1 | 4/2014 |
| DE | 102013010221 | A1 | 12/2014 |
| EP | 2740672 | | 6/2014 |
| EP | 3192641 | A1 | 7/2017 |
| EP | 3885085 | A2 | 9/2021 |
| FR | 3022818 | A1 | 1/2016 |
| WO | 0141984 | | 6/2001 |

OTHER PUBLICATIONS

PCT Patent Application PCT/EP2023/059800 International Search Report and Written Opinion issued Aug. 4, 2023.

* cited by examiner

SEPARATING UNIT

RELATED APPLICATION

The present application is a national stage application under 35 U.S.C. § 371 of International Application No. PCT/EP2023/059800, filed 14 Apr. 2023, which claims priority from German Patent Application No. 10 2022 111940.8, filed 12 May 2022 and German Patent Application No. 10 2022 118988.0, filed 28 Jul. 2022. The above-referenced applications are incorporated by reference.

SUMMARY

The invention relates to a separating unit for a packaging machine for packaging food products, in particular for arrangement in a molding station, in a heating station or in a combined heating and molding station of the packaging machine, wherein the separating unit is configured to process a material web, which is moved in the packaging machine along a transport direction, by means of a plurality of separating elements of the same type or of different types, in particular to produce perforations and/or peel corner cuts in the material web.

The invention furthermore relates to a station for a packaging machine for packaging food products, said station comprising at least one separating unit as disclosed herein and a counter-unit that, during operation, is arranged at the other side of the material web to be processed opposite the separating unit. This station can be a molding station, a heating station or a combined heating and molding station.

The invention further relates to a packaging machine for packaging food products comprising at least one station as disclosed herein.

The invention furthermore relates to a separating unit, a station or a packaging machine, in each case as disclosed herein, wherein the material web comprises at least one fibrous material layer that comprises or consists of fibrous material.

The invention also relates to a method for operating a packaging machine for food products for producing packages at least from a bottom material web and a top material web that enclose at least one product region of a respective package, wherein the bottom material web passes through a molding station as disclosed herein of the packaging machine, wherein recesses of the product regions are formed in the molding station in the bottom material web, and wherein, after the insertion of food products into the recesses, the material webs are connected to one another to close the product regions.

Devices for cutting through areal workpieces are generally known. Reference is for example made to DE 39 35 625 A1.

One possible application in the field of packaging machines for packaging food products is to form holes in marginal regions of the bottom material web, said holes being used in a subsequent sealing station to evacuate and gas the product regions before the closing. Such a punching of a bottom material web in a packaging machine is generally known. Another, equally well-known application is forming so-called peel corner cuts in the bottom material web. In this respect, slots are formed in the bottom material web, and indeed in each case in the region of one corner of a respective recess. After the separation of the packages, they are each provided with a peel corner, which peel corners make it easier for the consumer to open the package and can furthermore help the consumer to separate individual layers of the material web from one another more easily, e.g. to separate a plastic layer, also called a liner, more easily from a paper layer. In practice, such separating processes can be performed mechanically using knives or blades, wherein circular blade edges are used for the perforations and straight blade edges for the peel corner cuts.

Known separating units are relatively large, have a complicated structure and are often designed as separate devices that consequently require a relatively large amount of space and thus enlarge the packaging machine, wherein known separating units are furthermore cumbersome to maintain and clean and, moreover, a conversion for different applications of the packaging machine is often not possible or involves a great deal of effort.

In the field of packaging machines for packaging food products, the object of the invention is to improve the necessary processing of the material webs by means of separating elements and the handling of apparatuses provided for this purpose.

This object is in each case satisfied by the features of the independent claims.

The separating unit according to the invention is inter alia characterized in that it defines a separating plane that is in parallel with the material web during operation, a working direction perpendicular to the separating plane and a working width that is in parallel with the separating plane and perpendicular to the transport direction and that corresponds to the width of a respective material web, wherein the separating unit comprises a plurality of separate assemblies, which are arranged above one another in the working direction and which can in particular be mounted without tools, namely a base part, in particular a cover-like base part; a support frame which is fastened to the base part and at whose side facing away from the base part the separating plane is disposed; between the support frame and the base part, at least one holding plate which is movably supported at or in the support frame in the working direction and at whose side facing away from the base part at least one and preferably a plurality of separating elements projecting in the working direction are attached, wherein the support frame is provided with apertures for the separating elements; and between the holding plate and the base part, at least one pressure plate that acts as a drive for the holding plate, that can be acted on by compressed air connectable to the separating unit and that is configured to adjust the holding plate between a passive position with separating elements retracted into the apertures of the support frame and an active position with separating elements extended out of the apertures and through the separating plane.

Despite the arrangement of the individual assemblies above one another, it can be achieved that the separating unit only has a low construction height. The separating unit can be integrated into a molding station, a heating station or a combined heating and molding station of the packaging machine without increasing the construction height of the respective station to a relevant degree.

The separating unit can have an at least partly integrated design with respect to the working direction. In particular, the total construction height of the separating unit can be less than the sum of the construction heights of all or a subset of the assemblies. This can be realized by a nested arrangement with respect to the working direction of the or individual assemblies of the separating unit in the assembled state.

The separating stroke, i.e. the required movement for adjusting the separating elements, i.e. the movement for adjusting the holding plate provided with the separating elements, is integrated into the separating unit. This means that the separating unit as a whole does not need to be moved for the separating process. It is therefore possible, although not mandatory, to integrate the separating unit into a stationary part of a respective station that is not moved when opening or closing the station.

If, on the other hand, the separating unit is moved as a whole, for example, if it is integrated into a non-stationary part of a respective station that is moved when opening or closing the station, provision can then be made that one or more separating elements are attached to the support frame or integrated into the support frame. Furthermore, an attachment or integration of at least one separating element at or into the support frame is possible even if the separating unit is stationary. In this case, a drive is provided for the separating element and is configured to adjust the separating element relative to the support frame.

It is further of advantage that the separating unit is easy and safe for a user to handle since, in the passive position, the separating elements are in the retracted passive position. There is therefore no risk of injury.

Since the assemblies of the separating unit are separate assemblies, in particular modular assemblies, they can be easily replaced. This is in particular of advantage for a conversion of the separating unit. The holding plate comprising the separating elements can be replaced with another holding plate comprising other separating elements or comprising separating elements positioned differently at the holding plate in order to perform other separating functions at a respective material web. The support frame itself can also be replaced, for example, to enable the use of other holding plates that do not match every support frame. Provision can further be made that the separating elements can be completely removed.

The use of compressed air as a drive for the pressure plate makes the operation of the separating unit simple and reliable. In practice, compressed air is usually available at packaging machines anyway. Furthermore, the compressed air can be advantageously used for additional purposes, as explained in more detail elsewhere.

The integration of the separating unit into a molding station or into the molding section of a combined heating and molding station is particularly advantageous. The separating unit can in particular form a component of a molding station, in particular the upper part of a molding station. As a component of a molding station, the separating station can be configured to form recesses in the material web by reshaping the latter in that a molding pressure is built up in the separating unit by means of compressed air and drives the material web into negative molds of a lower molding tool, also called a counter-unit. This will be discussed in more detail below.

However, this integration of the separating unit into a molding station or the formation of a part of a molding station by the separating unit according to the invention is not mandatory. It is also possible to provide the separating unit at another station of the packaging machine, for example at a heating station that is arranged upstream of a molding station and that serves to heat the bottom material web before the molding process. It is also possible to provide the separating unit at a combined heating and molding station of a respective packaging machine, wherein the separating unit can then be arranged either at a heating section or at a molding section, as explained above, of this combined heating and molding station. Furthermore, the separating unit can be used to process material webs that are used in the production of so-called skin packs, i.e. material webs in which no recesses are formed, i.e. for which no molding station serving to form recesses is used. The separating unit can then e.g. be used to produce peel corner cuts in the material web, which is also advantageous for skin packs.

If the separating unit according to the invention is a component of a molding station, the integrated drive for the holding plate in the form of the pressure plate that can be acted on by compressed air has the advantage that the process of processing the material web by means of the separating elements, i.e. the actual separating process by adjusting the holding plate, can be adapted in terms of time to the sequence of the molding process in a manner that is optimal for the respective application.

For example, the separating process can take place when there is still sufficient molding pressure towards the end of the molding process or when sufficient molding pressure is already built up at the start of the molding process in order to use the built-up pressure to clean the separating points, which are produced in the material web by means of the separating elements, by a free blowing. Furthermore, the separating process can take place at a point in time at which the previously heated material web has already cooled down again to thus avoid unwanted effects such as deformations of the material web or adhesions of web material in the region of the separating elements.

Further possible embodiments of the separating unit according to the invention are explained below.

According to some embodiments, the separating unit can be connectable to a compressed air supply, wherein a molding pressure can be built up in a pressure space, which is bounded by the base part and the support frame, by means of supplied compressed air when, during operation, the support frame, with its side facing away from the base part, contacts the material web to form recesses in the material web by reshaping the material web by means of the molding pressure. In this embodiment, the separating unit can be integrated into a molding station of a packaging machine or can form a component of a molding station. The pressure space can be sealed with respect to the environment by a seal arranged between the base part and the support frame. Provision can in particular be made in this respect that the seal runs around a recess of the support frame, said recess serving to receive the holding plate.

According to some embodiment examples, provision can be made that the pressure plate and the holding plate are arranged within the pressure space. This enables a particularly compact design in the working direction and thus results in a relatively low construction height.

Furthermore, provision can be made that a plurality of separate holding plates, each comprising at least one and preferably a plurality of separating elements, are movably supported at or in the support frame. In this respect, it is possible, but not mandatory, that at least two separate holding plates are provided with separating elements of a different type in each case. In this way, the separating unit can be adapted to a respective application by providing appropriately designed holding plates and can be easily converted when the application is changed.

The holding plates can be assembled to form a total plate and can be jointly movably supported at or in the support frame.

The holding plates can be jointly adjustable by means of the pressure plate.

Furthermore, according to some embodiment examples, provision can be made that at least one holding plate has one or more separating elements of a first type and at least one further holding plate has one or more separating elements of a second type. The first type and the second type can be the same or different.

Furthermore, provision can be made that at least one holding plate is configured as a holder for at least one further holding plate. Provision can in particular be made in this respect that the one holding plate can be used without the further holding plate, but not vice versa.

According to some embodiment examples, provision can be made that the one holding plate fills the support frame in a plane in parallel with the separating plane and is provided with a receiver for the further holding plate. This constitutes a particularly easy-to-use option for combining a plurality of holding plates to form a total plate, to movably support them together at or in the support frame and to adjust them together by means of the pressure plate.

If a holding plate has a receiver for one or more further plates, this further plate can then—as explained above—likewise be a holding plate for one or more separating elements. If, in a respective application, no further separating elements are required in addition to the separating elements of the holding plate provided with the receiver, a dummy plate can be provided for this receiver, by which it is meant that this dummy plate merely closes the receiver, but does not itself contribute to the processing of the material web by means of separating elements, i.e. does not itself have any separating elements.

This concept of one or more dummy plates can also be used in conjunction with holding plates that each do not have a receiver for one or more further plates and do not fill the support frame, but that are each to be arranged by a side-by-side arrangement with the at least one further plate at or in the support frame in order to form a total plate.

Furthermore, provision can be made that the base part, the support frame, the holding plate and the pressure plate each extend across the working width and preferably each have a low construction height in the working direction compared to the working width.

The base part can have an end plate comprising two side walls spaced apart from one another in the direction of the working width and projecting towards the separating plane in the working direction, wherein the side of the end plate facing towards the separating plane and the side walls bound a receiving space for the support frame.

The support frame can be insertable into the receiving space of the base part. This enables a particularly simple and fast removal of the support frame, in particular together with the holding plate supported thereat, whereby maintenance and, if necessary, conversion can be simplified.

The end plate of the base part can have, at its side facing towards the separating plane, a recess for receiving the pressure plate.

Furthermore, provision can be made that the support frame has, at its side facing towards the base part, a recess for receiving the holding plate and an end plate in which the apertures for the separating elements of the holding plate are formed. Furthermore, provision can be made that openings corresponding to negative molds of a counter-unit are furthermore formed in the end plate.

In some embodiment examples, provision can be made that the total construction height of the separating unit in the assembled state is less than the sum of the individual construction heights of the base part and the support frame.

The holding plate and/or the support frame can be provided with one or more spring arrangements against whose return force the holding plate can be adjusted into the active position by means of the pressure plate and by which the holding plate is preloaded into the passive position. In the passive position of the holding plate, the separating elements are retracted into the apertures of the support frame. The spring arrangement therefore ensures that the arrangement of the support frame and the holding plate adopts a safe state in that there is no risk of injury to a user when handling this arrangement due to the separating elements.

Furthermore, provision can be made that the pressure plate and/or the base part is/are provided with one or more spring arrangements against whose return force the pressure plate, when acted on by compressed air, can be moved away from the base part in order to adjust the holding plate into its active position. This spring arrangement supports or effects the adjustment of the holding plate back into the passive position as soon as the application of compressed air has ended.

Instead of or in addition to spring arrangements, other devices that enable a resetting due to elastic deformation or to an active resetting can in each case also be provided, for example compressed air cylinders.

According to some embodiment examples, provision can be made that the pressure plate, at its side facing the base part, is provided with at least one flexible hollow body that can be connected to a compressed air supply and that can be inflated by applying compressed air. The drive for the holding plate can thus be realized in a particularly simple manner. Such a drive is in particular advantageous when compressed air is available at the packaging machine anyway or when the separating unit is operated with compressed air to carry out molding processes for forming recesses in the material web.

According to further possible embodiment examples, a set of different support frames that are mutually interchangeable at a base part and/or a set of different holding plates that are mutually interchangeable at a support frame or that can be used with different support frames can be provided. A conversion of the separating unit for different applications at a packaging machine can hereby take place in a particularly simple and time-saving manner. It is furthermore of advantage that, with the replaceable individual parts, significantly less weight has to be handled in each case than when removing or replacing a separating unit as a whole, irrespective of its specific design.

The station according to the invention is characterized, irrespective of whether it is a molding station, a heating station or a combined heating and molding station, in that the separating unit and the counter-unit can be moved relative to one another perpendicular to the separating plane in order to perform working strokes for closing and opening the station, and in that the adjustment movements of the holding plate of the separating unit that can be effected by means of the pressure plate can be performed in addition to the working strokes. It is furthermore of advantage that the adjustment movements—when the material web is stationary, i.e. does not move in the transport direction—can generally be performed at any desired point in time.

The station is preferably configured such that the processing of the material web by means of the separating elements, in particular the production of perforations and/or peel corner cuts in the material web, takes place at a point in time when the material web is fixedly held between the separating unit and the counter-unit, in particular clamped between the separating unit and the counter-unit. Here, the material web is therefore not only held by laterally engaging transport devices, such as the clamping chains typically used in packaging machines, but additionally by the mutually facing surfaces of the separating unit and the counter-unit. It has been shown that particularly good processing results can hereby in particular be achieved with very thick or very thin material webs. In particular, a better cutting pattern can hereby be produced than in the prior art.

This procedure, i.e. the processing of the material web when it is held, in particular clamped, between the separating unit and the counter-unit, also represents a preferred further development of the method according to the invention disclosed herein.

It is generally possible that the working strokes for closing and opening the station are positively coupled to the adjustment movements of the holding plate, as to the separating processes. However, the station is preferably configured such that the working strokes and the separating processes are at least partly decoupled from one another and are in particular independent of one another. The station or the packaging machine comprising the station is in particular provided with a control device that is configured to control the operation of the station in dependence on the operation of the packaging machine as a whole in a respective desired manner, wherein this control in particular includes that the opening and closing of the station can be controlled independently of the separating processes, i.e. of the adjustment of the holding plate.

Provision can in particular be made that the station can be controlled such that a respective separating process takes place during a respective working stroke, at the end of a respective working stroke or following a respective working stroke.

As already mentioned, it is generally possible for the separating unit to be arranged below the separating plane, wherein the counter-unit is arranged above the separating plane. However, an arrangement is preferred such that the counter-unit is arranged below the separating plane and the separating unit is located above the separating plane. The relative movability of the separating unit and the counter-unit can be realized such that the separating unit is stationary with respect to the working direction, i.e. it is not raised or lowered to close and open the station, wherein only the counter-unit performs the working stroke, also called the lower stroke. However, it is generally possible to additionally provide an upper stroke for the separating unit. Whether an upper stroke is provided for the separating unit can be made dependent on the structural conditions at the respective packaging machine and on which respective application is to be performed with the packaging machine.

According to some embodiment examples, provision can be made that the station is a molding station or a combined heating and molding station that is configured to form recesses in the material web by reshaping the latter, wherein the counter-unit comprises a plurality of negative molds and the support frame comprises openings corresponding to the negative molds, wherein, when the station is closed, a molding pressure can be built up in the separating unit, at the side of the separating plane facing the base part, by means of compressed air in order to drive the material web into the negative molds and thus to form the recesses, and wherein, during or after completion of the build-up of the molding pressure, the holding plate of the separating unit can be adjusted into the active position to process the material web by means of the separating elements.

A respective separating process can take place, for example, during or after completion of the build-up of the molding pressure. The separating process can in particular take place when recesses are each already at least partly formed. This inter alia has the advantage that a material web possibly heated before the molding process has already cooled down again when the separating elements come into contact with the material web.

As already mentioned elsewhere, it is not absolutely necessary for the separating unit to be a component of a molding station. Provision can also be made that the station is a heating station or a combined heating and molding station, wherein the counter-unit is a heating unit that is configured to heat the material web.

Irrespective of the specific design of the station, in some embodiment examples provision can be made that the counter-unit is provided with cut-outs that correspond to the separating elements of the separating unit and that are configured to receive the extended separating elements.

At least some of these cut-outs can be provided with escape and/or suction openings via which compressed air can escape after the processing of the material web has taken place and/or which can be acted on by negative pressure.

Impurities that arise due to the separating process, in particular so-called cutting dust that can accrue when cutting fibrous material, can be removed in this way, wherein it is particularly reliably prevented that such impurities enter the product regions.

Furthermore, provision can be made that the counter-unit is supported directly or via a lower part at a lifting apparatus that is configured to raise and lower the counter-unit in order to perform lower strokes, and thus to close and open the station or to contribute to these working strokes.

As mentioned elsewhere, an upper stroke can be provided for the separating unit. The lifting apparatus can then be configured to also perform this upper stroke. The use of lifting apparatuses that can be easily converted such that work can selectively take place with or without an upper stroke is particularly advantageous.

If the station is a combined heating and molding station, a common lower part can be provided at which the lifting apparatus engages and which carries, for example, one or more heating units of a heating station arranged upstream and a lower part of a molding station.

As already mentioned elsewhere, the invention furthermore relates to a packaging machine for packaging food products comprising at least one station as disclosed herein, wherein this station comprises at least one separating unit as disclosed herein.

According to some embodiments of this packaging machine, provision can be made that the support frame together with the holding plate can be removed from the separating unit with the base part remaining at the packaging machine. This removal can in particular take place by pulling the support frame out of the base part in parallel with the transport direction of the packaging machine.

In this respect, provision can be made according to some further developments that the support frame is supported on the packaging machine. This can take place via one or more sliding or rolling members that are in particular attached to the support frame.

It can hereby be achieved that the support frame slides or rolls along the packaging machine during a removal from the separating unit. For this purpose, the packaging machine can be equipped with rails or strips specifically provided for this purpose or other parts extending in the direction of the removability of the support frame.

This provides a conceivably convenient and quick option for removing the support frame, for example, for maintenance or cleaning purposes or for conversion by changing the support frame and/or by changing one or more holding plates. Consequently, only the weight of the holding plate needs to be handled by a user to change a holding plate since the support frame is supported at the packaging machine. The weight of a holding plate is unproblematic for a user so that this concept relieves the user.

The invention further relates to a separating unit for a packaging machine for packaging food products, in particular for arrangement in a molding station, in a heating station or in a combined heating and molding station of the packaging machine, wherein the separating unit is configured to process a material web, which is moved in the packaging machine along a transport direction, by means of a plurality of separating elements of the same type or different types, in particular for producing perforations and/or peel corner cuts in the material web.

The separating unit can define a separating plane that is in parallel with the material web during operation, a working direction perpendicular to the separating plane and a working width that is in parallel with the separating plane and perpendicular to the transport direction and that corresponds to the width of a respective material web.

In some embodiments, provision can be made that the separating unit comprises a base at or in which the separating elements are movably supported relative to the base in a working direction. In particular, the separating elements can be adjustable by means of a drive between a passive position, in particular with separating elements retracted into apertures of the base, and an active position, in particular with separating elements extended out of apertures of the base and through a separating plane.

In some embodiments, provision can be made that the separating elements are arranged at the base in such a manner that they can be replaced individually or in groups or all together.

In some embodiments, provision can be made that the base comprises a base part, in particular a cover-like base part, and a support, in particular a support frame, which is fastened to the base part and at whose side facing away from the base part a separating plane is disposed, in particular wherein the support can be inserted into a receiving space of the base part.

According to some embodiments, the separating elements can be attached to at least one holding unit, in particular at least one holding plate, that is adjustable by means of a drive.

Such a holding unit can, for example, have one or more holding plates and can be arranged as shown in the embodiment example according to FIGS. 2 to 9. Alternatively, the holding unit—irrespective of its specific design—can also be arranged at the lower side of the separating unit. This is particularly advantageous if the separating unit or an upper part of a molding station comprising the separating unit can be moved into a maintenance position, e.g. by pivoting upwards about an axis preferably extending in parallel with the transport direction of the respective packaging machine, so that the lower side of the separating unit is easily accessible to a user and a holding unit arranged there can be particularly easily removed and replaced. The upper part of a molding station is also called the upper tool or the upper molding tool.

The holding unit can be arranged at the side facing the base part or at the side of the support facing away from the base part.

According to some embodiments, the holding unit can be movably supported at the base, in particular at a support of the base, in a working direction.

In some embodiments, provision can be made that the holding unit can be received in a recess of the base, in particular of a support of the base.

Furthermore, provision can be made that the holding unit can be inserted into the base.

In some embodiments, provision can be made that the holding unit is arranged at a side of the base that, during operation, faces the material web to be processed, in particular at the lower side of the base when the separating unit is located above the material web during operation.

The holding unit can be a separate assembly, in particular a modular assembly, that is arranged at the base in a replaceable manner and that can in particular be mounted without tools.

Furthermore, provision can be made that the base part, the support and the holding unit form a plurality of separate assemblies, in particular modular assemblies, that are arranged above one another in the working direction and that can in particular be mounted without tools.

According to some embodiment examples, one or more individual drives, in particular one or more compressed air cylinders or one or more electric motors, preferably one or more servomotors, can be provided as a drive for adjusting the separating elements or a holding unit to which the separating elements are attached. Alternatively, a pressure unit, in particular a pressure plate, can be provided as a drive for adjusting the separating elements or a holding unit to which the separating elements are attached, which pressure unit can be acted on by compressed air connectable to the separating unit and is configured to adjust the separating elements or the holding unit between the passive position and the active position.

The invention furthermore relates to a molding station or an upper part of a molding station or a lower part of a molding station for a packaging machine for packaging food products, said molding station or upper part or lower part thereof comprising a separating unit as disclosed herein.

The station is in particular a molding station or a combined heating and molding station that is configured to form recesses in the material web by reshaping the latter, in particular wherein the station is configured for a reshaping without the effect of heat or for a reshaping by thermoforming.

Such molding stations and methods for reshaping material webs at packaging machines are generally known to the skilled person. Thermoforming is understood as the reshaping of a respective semi-finished product—here the bottom material web—at an elevated temperature. Thermoforming is also called hot forming or deep drawing so that the molding station is also called a deep-drawing station. However, aspects of the invention that relate to or include a reshaping of the material web are not limited to a reshaping at an elevated temperature, i.e. to a reshaping under the effect of heat. The reshaping of the bottom material web can also take place without the effect of heat, i.e. not by thermoforming. Unless otherwise stated below, general terms such as "reshaping" and "molding station" refer to both variants, i.e. both to the thermoforming and to the reshaping without the effect of heat. A reshaping without the effect of heat can be, for example, achieved by compressed air forming, by vacuum forming, by a combined compressed air and vacuum forming or by die forming. In the case of thermoforming, the reshaping of the material web can also take place by compressed air forming, by vacuum forming, by a combined compressed air and vacuum forming or by die forming, but only at a previously heated material web.

Against this background, provision can be made that the station is configured to perform the reshaping of the material web by compressed air forming, by vacuum forming, by a combined compressed air and vacuum forming or by die forming.

Furthermore, provision can be made that the separating unit is a component of an upper part or of a lower part of the molding station or that the separating unit forms the upper part or the lower part of the molding station. In this respect, the separating unit can be configured as a tool or as a part of an overall tool for reshaping the material web, in particular for reshaping the material web by compressed air forming, by vacuum forming, by a combined compressed air and vacuum forming or by die forming, said part of an overall tool preferably cooperating with a counter-unit that, during operation, is arranged at the other side of the material web to be processed opposite the separating unit.

The invention further relates to a packaging machine for packaging food products comprising at least one station as disclosed above.

As also already mentioned elsewhere, the material web to be processed can comprise at least one fibrous material layer that that comprises or consists of fibrous material. In this case, according to some further developments of the invention, provision can be made that the packaging machine has a pretreatment device that is configured to subject the material web to a pretreatment in which the moisture content of the fibrous material layer is changed, in particular increased.

In connection with a method according to the invention for operating a packaging machine, provision can in particular be made that the packaging machine is operated in a clocked manner, wherein work cycles alternate with pre-drawing cycles serving to pre-draw the material webs. This is generally known to the skilled person. During a work cycle, for example, recesses are formed in the bottom material web at the molding station, products are inserted into the recesses at an insertion station arranged downstream, for example by means of a conveyor belt also called an inserter or by means of a robot, and the material webs are connected to one another at a sealing station arranged further downstream in order to seal the product regions with the food products located therein. In practice, a packaging machine usually has further work stations that do not need to be discussed in detail here. A possible embodiment example of a packaging machine is described in more detail elsewhere.

In the method according to the invention, provision can in particular be made that the counter-unit cooperating with the separating unit according to the invention comprises a plurality of negative molds and the support frame of the separating unit comprises openings corresponding to the negative molds, wherein, in a respective work cycle, when the station is closed, a molding pressure is built up in the separating unit, at the side of the separating plane facing the base part, by means of compressed air in order to drive the bottom material web into the negative molds and thus to form the recesses, wherein the holding plate of the separating unit is adjusted into the active position to process the bottom material web by means of the separating elements.

Furthermore, according to some embodiment examples of the method, provision can be made that the regions at which the bottom material web is processed by means of the separating elements are freed from processing residues by a blowing out and/or by suction in that compressed air and/or negative pressure is applied to at least these regions.

In this respect, provision can in particular be made that an air flow is generated by means of compressed air and/or negative pressure through openings in the bottom material web that are produced during the processing by means of the separating elements.

As already initially mentioned, the processing of the bottom material web takes place by means of the separating elements, in particular for the purpose of providing side regions of the material web with a perforation, wherein the processing can alternatively or additionally take place to produce a peel corner cut in each case in particular in the region of a corner of a respective recess of the material web. Here, the separating elements therefore produce holes or cuts in the bottom material web. These openings can be used to remove processing residues that arise during their production.

A molding pressure used to produce the recesses by reshaping can be used for such a cleaning. In particular, provision can be made in the method according to the invention that the holding plate is adjusted into the active position at a point in time at which a molding pressure above the environmental pressure is built up. This can, for example, take place in an initial phase of a molding process when the molding pressure is already partly built up and is above the environmental pressure. Alternatively, the separating process can take place in a final phase of a respective molding process when the molding pressure has already been partly reduced, i.e. no longer has a maximum value, but is still above the environmental pressure. Optionally, this cleaning can be supported by applying a negative pressure.

The reducing of the molding pressure can, for example, take place by opening the molding station. In such a case, provision can be made that the holding plate is adjusted into the active position before the molding station is opened. At least a portion of the molding pressure can then escape through the openings produced in the bottom material web by means of the separating elements, and can thus remove processing residues.

As already mentioned elsewhere, it can be advantageous to only bring the separating elements into contact with the material web when it has already at least partly cooled down again in the event of a prior heating. In this connection, provision can be made in the method according to the invention that the holding plate is adjusted into the active position at a point in time at which the recesses have each already been at least partly formed.

BRIEF DESCRIPTION OF THE DRAWINGS

The invention will be described in the following by way of example with reference to the drawing. There are shown.

DETAILED DESCRIPTION

Figure 1:
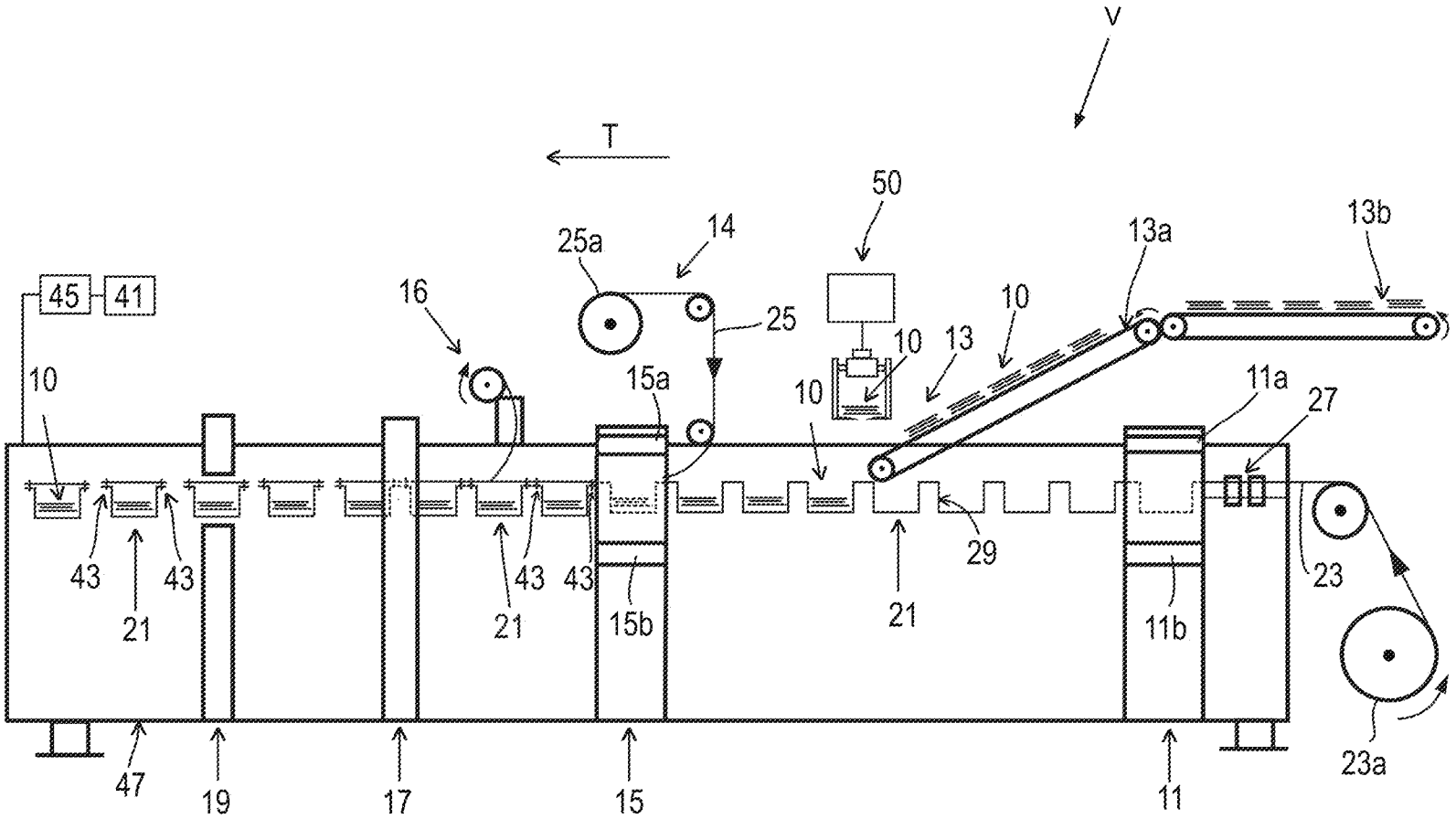
Fig.1 Prior Art
FIG. 1 schematically, in a side view, a packaging machine according to the prior art.

The packaging machine according to the prior art, which is described below with reference to FIG. 1, can be equipped with a station according to the invention, which comprises a separating unit according to the invention, for example a combined heating and molding station 12 and a separating unit 51, as described with reference to FIGS. 2 to 9, instead of a conventional molding station (provided with the reference numeral 11 in FIG. 1). Such a packaging machine can then be operated according to the method according to the invention.

The packaging machine V shown in FIG. 1 that operates in a transport direction T comprises a machine frame 47. A transport chain 27, which is only schematically shown here at the upstream end of the machine, is guided at a left side frame and at a right side frame of the machine frame 47 in each case. The two transport chains 27 together form a transport device for a bottom web 23 drawn from a supply roll 23*a*.

The machine comprises a plurality of work stations following one another in the transport direction T, namely a molding station 11 also called a deep-drawing machine or a thermoforming machine, an insertion station 13 for products 10 to be packaged, a feed station 14 for a top web 25 drawn from a supply roll 25*a*, a labeling and/or printing station 16, a transverse separating station 17 and a longitudinal separating station 19.

The products 10 to be packaged are, for example, food products, here in the form of so-called portions, that each comprise a plurality of slices that were previously cut off from a loaf-shaped or bar-shaped food, such as sausage, cheese, ham or meat, by means of a food slicer (not shown). The slicer and the packaging machine can form a continuous production line.

A central control device 41 controls the operation of the packaging machine V, including the work stations mentioned. It can also control the slicer or be connected to a control device of the slicer. Furthermore, the packaging machine V is preferably provided with an operating device 45 that e.g. comprises a touch screen at which all the necessary information can be displayed to an operator and the operator can make all the necessary settings before and during the operation of the machine.

The design and operation of said work stations are generally known to the skilled person so that they will not be discussed in detail here.

At the molding station 11 comprising an upper tool 11*a* and a lower part 11*b*, recesses 29, also called depressions, are each formed in a deep-drawing process in the bottom web 23 and are each part of a product region 20 of the respective finished package 21, wherein a finished package 21 can also comprise a plurality of product regions. The portions 10 mentioned are inserted into these recesses 29 at the insertion station 13. The insertion station 13 here comprises a so-called feeder of which two endless conveyor belts 13*a*, 13*b* are shown. Alternatively or additionally, the insertion station 13 can comprise a robot 50, e.g. in the form of a so-called "picker", that is likewise schematically shown here and that can be configured as a delta robot having a gripper 52 that comprises two claws jointly holding a respective portion 10. Such robots and their use in the handling of foods, in particular when inserting portions into recesses of packages, are generally known to the skilled person so that further statements are not necessary here.

The bottom web 23 provided with the filled recesses 29 and the top web 25 are subsequently fed to the sealing station 15 that comprises an upper part 15*a* and a lower part 15*b*. The top web 25 and the bottom web 23 are connected to one another by means of these parts 15*a*, 15*b*. The recesses 29 and thus the packages 21, which are formed by the top web 25 and the bottom web 23 and which each comprise a product region 20, are hereby closed. Sealing points 43, also called sealing seams, extending transversely to the transport direction T are schematically indicated in FIG. 1.

Subsequent to the sealing station 15, the packages 21 are still connected by the top web 25 and the bottom web 23 and therefore still have to be separated. In the embodiment example shown here, the packages 21 are provided with labels 54 and/or are printed at the labeling and/or printing station 16 before the separation. The labeling and the printing can also take place in separate stations.

Further conveyor belts and/or work stations, for example a scale for checking the weight of the packages 21, can be provided downstream of the separating stations 17, 19.

Applications can e.g. differ from one another with respect to the kind of products 10 to be packaged, the size/shape of the recesses 29 in the longitudinal and/or transverse direction or with respect to a format set. A format set here generally refers to a group of items, here in particular both of portions 10 and recesses 29 or packages 21, that are handled as a whole—i.e. format set-wise—and that in particular differ from one another by the number and distance of items in the longitudinal direction and transverse direction.

Thus, e.g. per work cycle of the packaging machine, a packaging format or format set of 3×4 (3 in the transverse direction and 4 in the longitudinal direction) recesses 29 or product receivers of other kinds can be formed in the molding station 11, a format set of 3×4 correspondingly arranged products 10 can be inserted into a respective format set of recesses 21 at the insertion station 13, and a respective format set of 3×4 recesses 29 filled with products 10 can be sealed at the sealing station 15. The same analogously applies to the labeling and/or printing station 16. An arbitrarily dimensioned N×M format set can generally be formed, where N>=1 and M>=1.

Figure 2:
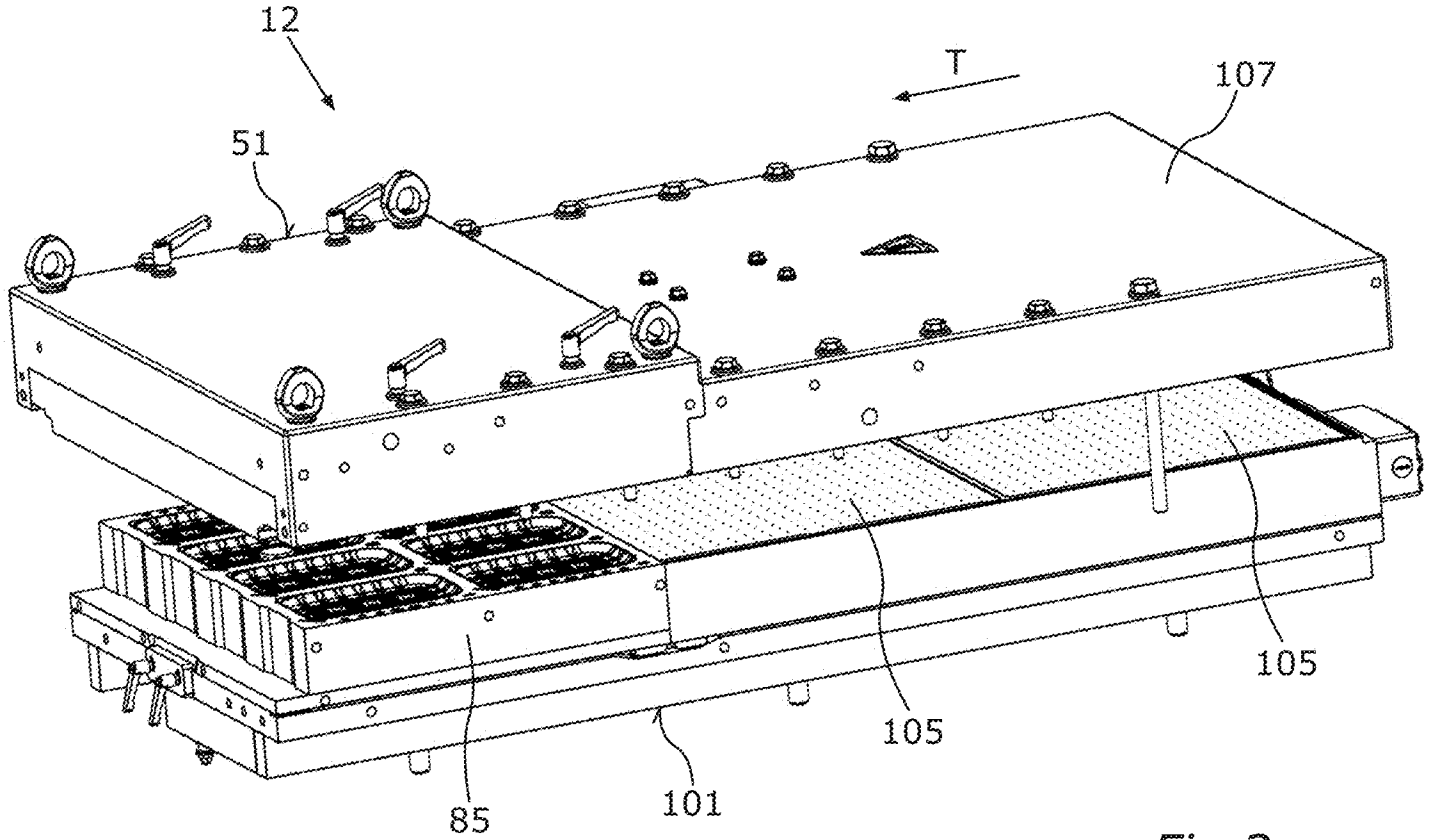
FIG. 2 in a perspective view, a possible embodiment example of a combined heating and molding station according to the invention with a separating unit according to the invention.

As FIG. 2 shows, the combined heating and molding station 12 comprises a common lower part 101 that, in the state installed in the packaging machine V, is supported at a lifting apparatus, not shown here, that is configured to raise and lower the lower part 101 in order to perform respective working strokes during the operation of the packaging machine V in order, in this way, to move the components, explained in more detail below, that are carried by the lower part 101 relative to a separating unit 51 according to the invention and an upper part 107.

A lower molding tool 85, which is also called a counter-unit to the upper separating unit 51 here, and two heating units 105, which are arranged upstream of the molding tool 85 viewed in the transport direction T of the packaging machine V, are carried by the lower part 101.

During the operation of the packaging machine V, the bottom material web 23 is located in a plane between the lower assemblies 85, 105 and the upper assemblies 51, 107. The heating units 105 serve to heat the material web 23 before the molding process, which is performed using the separating unit 51, also called the upper tool, and the lower molding tool 85, in order to form recesses 29 in the material web 23, as described with reference to FIG. 1.

Such an approach is generally known to the skilled person. What is new here is, among other things, the separating unit 51, which here forms a component of the combined heating and molding station 12, and the associated operation of the packaging machine V for a user. The design and mode of operation of the separating unit 51 and also its cooperation with the counter-unit 85 are described in more detail below with reference to FIGS. 3 to 9.

The material webs used, i.e. the bottom web 23 and the top web 25 (cf. FIG. 1), can be the typical film webs that often comprise a plurality of layers of different plastic materials. In such a case, one also simply speaks of the bottom film 23 and the top film 25. To produce more environmentally friendly packaging, it is already known to use material webs with a paper content. For example, it is possible to use a comparatively thick paper layer as a stability support and one or more comparatively thin layers of plastic as a support for food products.

Against this background, provision can also be made with the invention that the bottom material web 23 comprises at least one fibrous material layer that comprises or consists of fibrous material. In this respect, the bottom material web 23 can be formed as a single layer, i.e. consist of exactly one layer, namely the fibrous material layer. Alternatively, the bottom material web can be multi-layered, i.e. have a plurality of material layers that are already connected to one another during the production of the material web. Each of the plurality of layers can be a fibrous material layer so that the bottom material web is a fibrous material web without a film web, i.e. without a layer of plastic. Depending on the nature of the respective fibrous material layers and the properties of the food products to be packaged, a fibrous material layer—at least after passing through the molding station—can be suitable for serving as a support for the food products. Alternatively, in the case of a multi-layer bottom material web, provision can be made that an upper layer can comprise one or more film layers of plastic and a lower layer comprises one or more fibrous material layers. The upper side of the plastic layer or of the uppermost plastic layer then serves as a support surface for the food products to be packaged, while the lower side of the fibrous material layer or of the lowest fibrous material layer forms the outer side of the bottom material web and thus the lower outer side of a respective finished package.

It is not a subject of the present invention, but the circumstance should be mentioned in connection with the present invention that packages of fibrous material or having a fibrous material content exhibit a high dimensional stability even after a long time and even after a comparatively more robust handling during transport and storage if, before the molding process, the respective material web is subjected to a pretreatment in which the moisture content of the fibrous material layer is influenced. The pretreatment can be a drying in order to reduce an initial moisture content of the fibrous material layer. In most cases, however, the bottom material web will be in an initial state in which the fibrous material layer has a moisture content whose increase results in an improvement in the dimensional stability after the molding process, i.e. after the recesses have been formed. Therefore, in preferred applications, provision can be made that the pretreatment increases the moisture content of the fibrous material layer compared to an initial state. Accordingly, a packaging machine according to the invention can have a pretreatment device that is arranged upstream of the respective molding station or that is at least partly integrated into the molding station and that is configured to subject the bottom material web to a pretreatment in which the moisture content of the fibrous material layer is changed, in particular increased.

This concept is of importance in connection with the present invention in that the separating unit according to the invention and a molding station comprising this separating unit can also be configured to process such above-explained material webs that comprise at least one fibrous material layer. This processing comprises both processing with the separating elements of the separating unit, i.e. in particular the production of perforations and/or peel corner cuts in the material web, and the molding process for forming the recesses in the material web.

Figure 3:
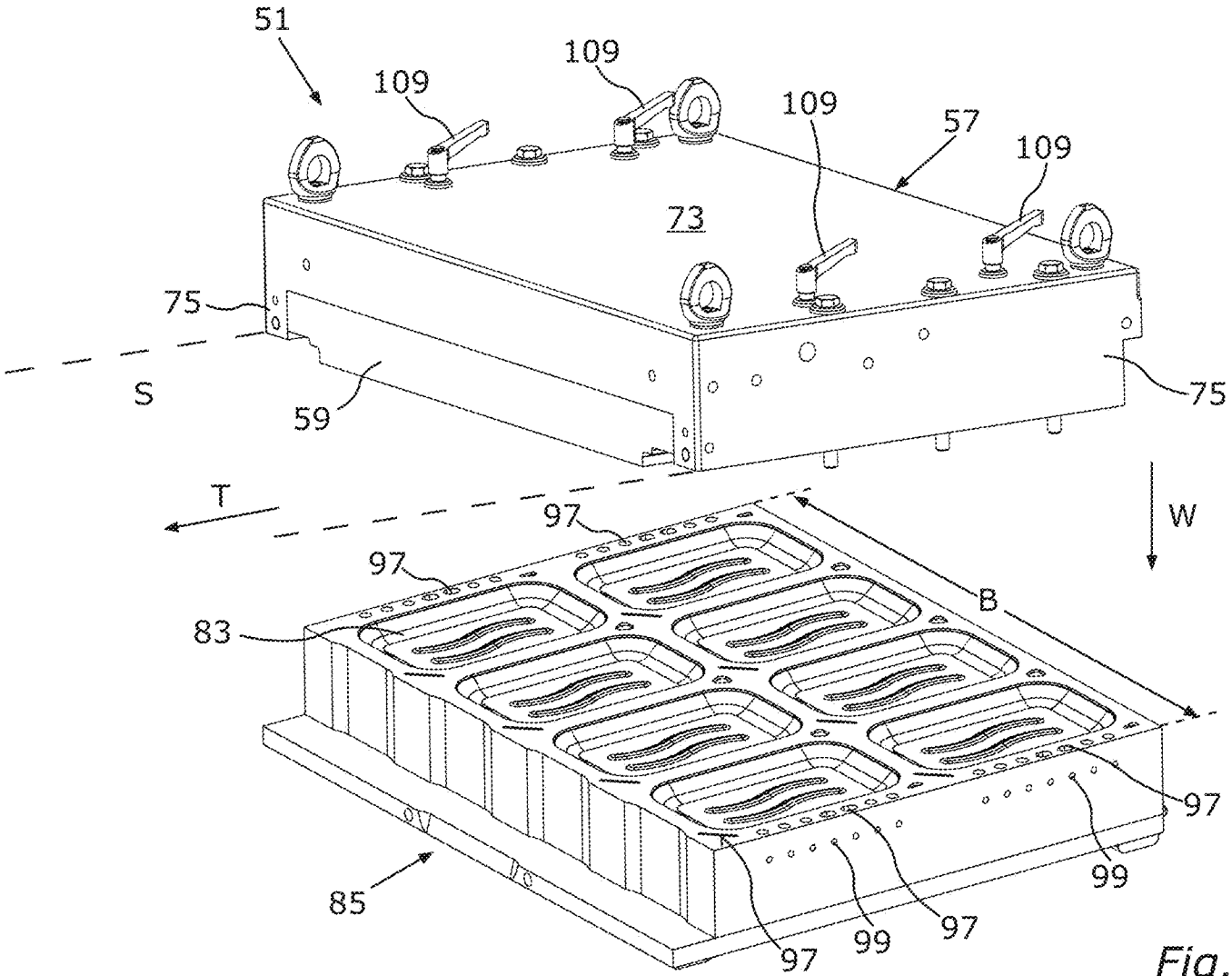
FIGS. 3 to 9 different views of the separating unit according to the invention of FIG. 2.
Figure 4:
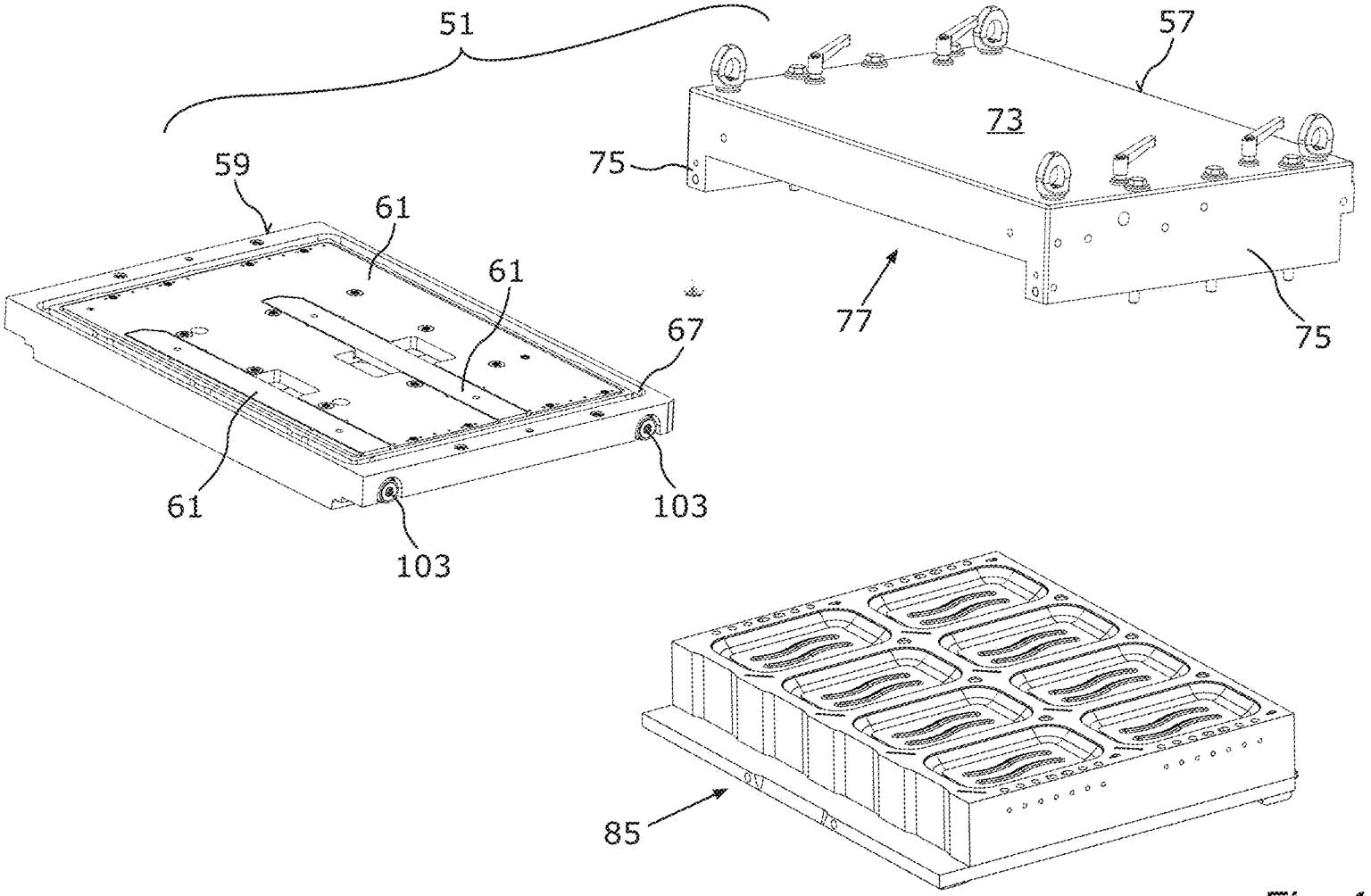

FIG. 3 shows the separation unit 51 and the counter-unit 85. The lower side of the separating unit 51 defines a separating plane S in which the bottom web 23 to be processed is located when the station is closed, i.e. when the distance between the separating unit 51 and the counter-unit 85 in the working direction W is at its smallest.

Recesses 83, also called negative molds, are formed at the upper side of the counter-unit 85. The separating unit 51, more precisely a support frame 59 together with holding plates 61, which are not shown and which will be discussed in more detail below, and the counter-unit 85 are configured here for an application in which eight recesses are formed in the material web per work cycle. An array of 2×4 recesses is therefore formed in one work cycle, namely four recesses in the direction of the working width B and two recesses in the transport direction T.

For separating elements of the separating unit 51 that are described in more detail below, the counter-unit 85 is provided with cut-outs 97 at its upper side. Rows of cut-outs 97 provided in the lateral marginal regions and extending in the transport direction correspond to separating elements of the separating unit 51 that are provided for producing perforations in the material web. In addition, a slot-shaped cut-out 97 extending obliquely to the transport direction T is provided in the region of a corner of each recess 83 and serves to receive a separating element of the separating unit 51 that performs a peel corner cut in the material web.

For the cut-outs 97 in the lateral marginal regions of the counter-unit 85, escape or suction openings 99 are formed that each open to the side and that are connected to a respective cut-out 97 so that compressed air, which is applied to the cut-outs 97, can escape through the openings 99 or negative pressure can be applied to the cut-outs 97 via the openings 99.

In addition to the support frame 59 already mentioned, the separating unit 51 comprises a base part 57 that is configured as an end cover of the separating unit 51 and comprises an end plate 73 having side walls 75. The end plate 73 and the side walls 75 define a receiving space 77 (cf. FIG. 4) for the support frame 59 that can be inserted into this receiving space 77.

In the inserted state according to FIG. 3, fixing screws 109 serve to fix the support frame 59 to the base part 57. For this purpose, the support frame 59 is provided with threaded openings into which threaded rods of the fixing screws 109 can be screwed. The fixing screws 109 are adapted for a manual actuation.

FIG. 4 again shows the counter-unit 85 and the separating unit 51, wherein the latter is shown with the support frame 59 removed from the base part 57.

The receiving space 77, which is downwardly open towards the counter-unit 85 and is bounded by the lower side of the end plate 73 and the two side walls 75, can be seen at the base part 57.

The support frame 59 is provided with two rollers 103 at each side; however, said rollers do not cooperate with the base part 57, but rather, in the assembled state, with the packaging machine V, which will be discussed in more detail below.

At its upper side facing the base part 57 in the assembled state, the support frame 59 is provided with a recess 71 (cf. FIG. 5) in which three holding plates 61 are arranged in the embodiment example shown here. A large, areal holding plate 61 fills the recess and serves as a support for two smaller, narrow elongated holding plates 61, i.e. strip-shaped holding plates 61. These holding plates 61 are described in more detail below. The holding plates 61 end flush with one another at their upper sides to be jointly acted on by a pressure plate 63 (cf. FIGS. 8 and 9), not shown in FIG. 4, arranged at the base part 57. Due to this action, the holding plates 61 are pressed downwardly within the support frame 59, whereby separating elements attached to the lower sides of the holding plates 61 are moved downwardly out of the support frame 59 and through the mentioned separating plane, and indeed into the cut-outs 97 at the upper side of the counter-unit 85 that are described in connection with FIG. 3.

Figure 5:
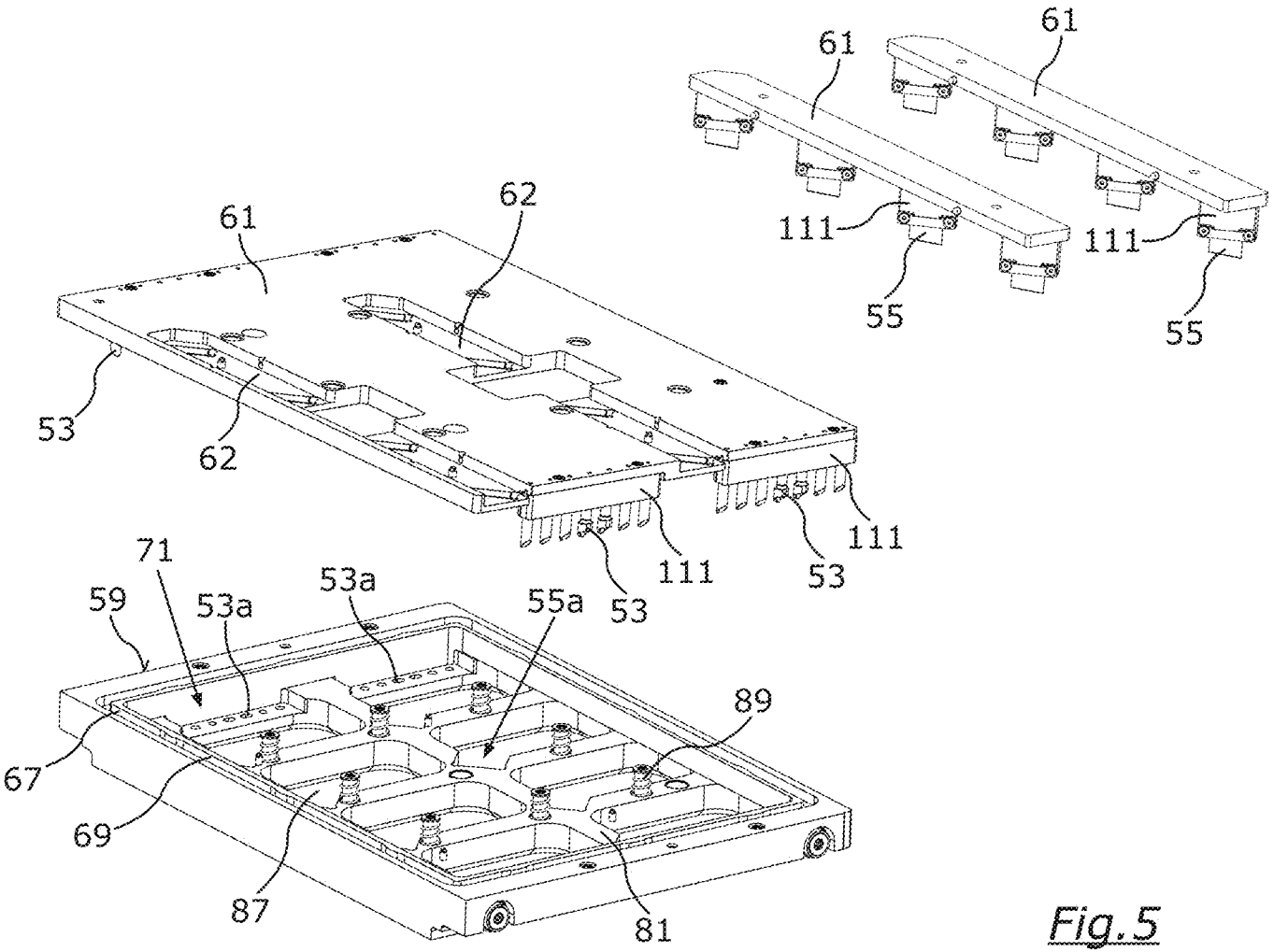

The separating elements mentioned are shown in FIG. 5 in which the holding plates 61 are shown in the state removed from the recess 71 of the support frame 59.

The large, areal holding plate 61 is provided with two holders 111, which are releasably connected to the holding plate 61, at the marginal regions. The holders 111 carry the separating elements 53 that each have a circular cross-section, that are chamfered at their free ends and that are configured as blade edges here. These perforating blades 53 serve to produce perforations in the marginal regions of the material web 23.

The separating elements 55, which are configured as blades with slightly chamfered blade edges and which are each attached via a holder 111 to the two small, narrow holding plates 61, serve for the peel corner cuts mentioned.

A replacement of the blades 53, 55 is possible either by removing a respective blade 53, 55 from its holder 111 or by removing the respective holder 111 together with the blades 53, 55 from the respective holding plate 61.

The large holding plate 61 is provided with receivers 62 for the small holding plates 61 into which said small holding plates can be inserted so that (cf. FIG. 4) the holding plates 61, in the assembled state, form a total plate that has a continuous planar surface and is completely received within the recess 71 of the support frame 59.

The recess 71 of the support frame 59 and the large holding plate 61 are geometrically matched to one another such that the holding plate 61 is received in the support frame 59 with a precise fit so that the blades 53 attached to the large holding plate 61 and the blades 55 of the small plates 61 inserted into the large plate 61 are aligned with apertures 53*a* and 55*a* (see FIG. 7) that are formed in a lower end plate 81 of the support frame 57. This end plate 81 downwardly bounds the recess 71. The end plate 81 is not only provided with the mentioned apertures 53*a*, 55*a* for the blades 53, 55, but furthermore with openings 87 that correspond to the negative molds 83 of the counter-unit 85 in the assembled state of the station 12 (cf. FIG. 2).

The end plate 81 of the support frame 59 thus comprises a plurality of webs that bound the openings 87. Upwardly projecting spring arrangements 89 are attached to these webs and each comprise a compression spring. The large holding plate 61 rests on these spring arrangements in the state inserted into the support frame 59 (cf. FIG. 4). The holding plates 61 can jointly be pressed downwardly against the return force of these spring arrangements 89, i.e. in the direction of the end plate 81 of the support frame 59.

At the upper side of the support frame 59, a groove 67 is formed which runs around the recess 71 and in which a seal 69, only partly and schematically indicated in FIG. 5, is inserted that seals a pressure space 65 (cf. FIG. 7) with respect to the environment when the support frame 59 (cf. FIG. 3) is inserted into the base part 57. This will be discussed in more detail elsewhere.

Figure 6:
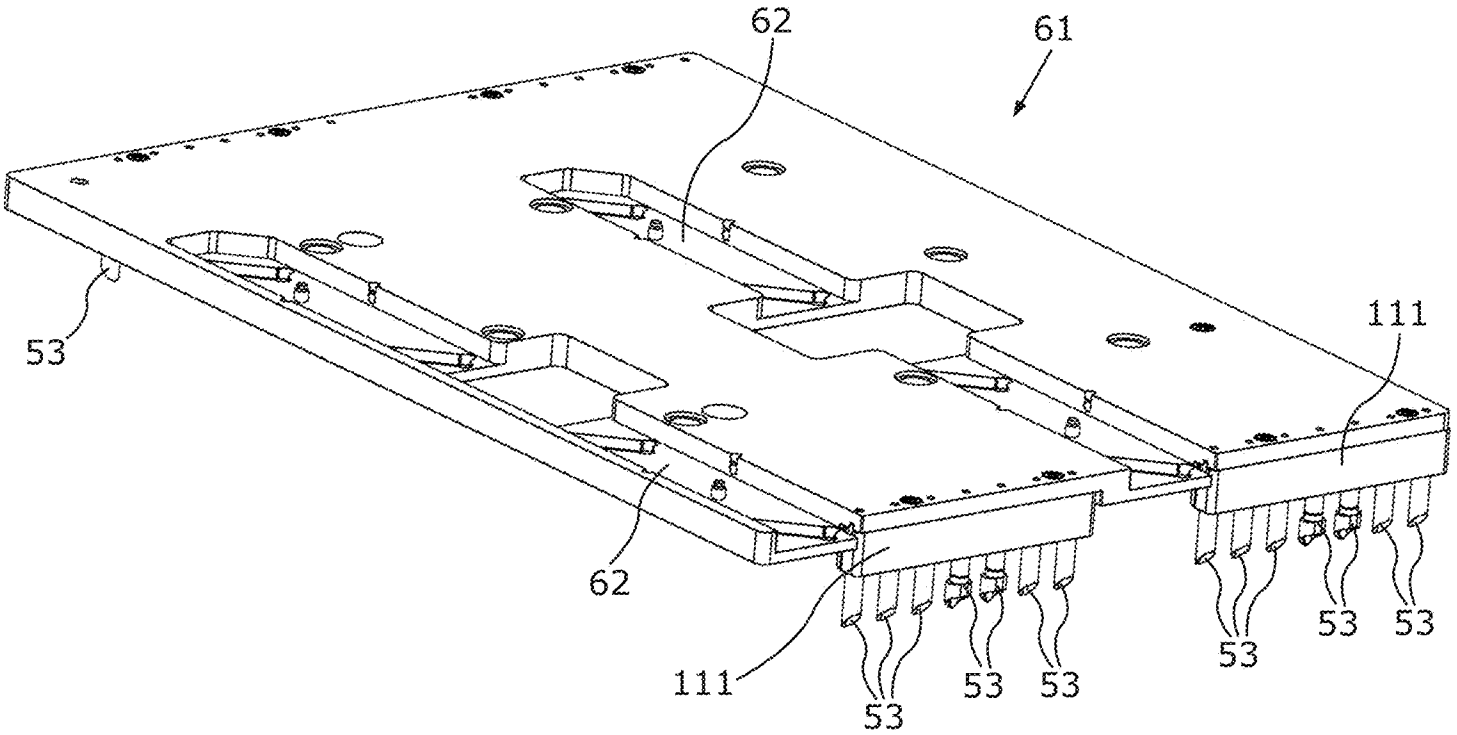

FIG. 6 shows the large holding plate 61 of FIG. 5 in an enlarged representation. It can in particular be seen here that, at each blade holder 111, two blades 53 are designed differently from the other five blades 53. This illustrates that the blade holders 111 and thus the holding plate 61 overall can be fitted with different blade configurations depending on a respective application.

Figure 7:
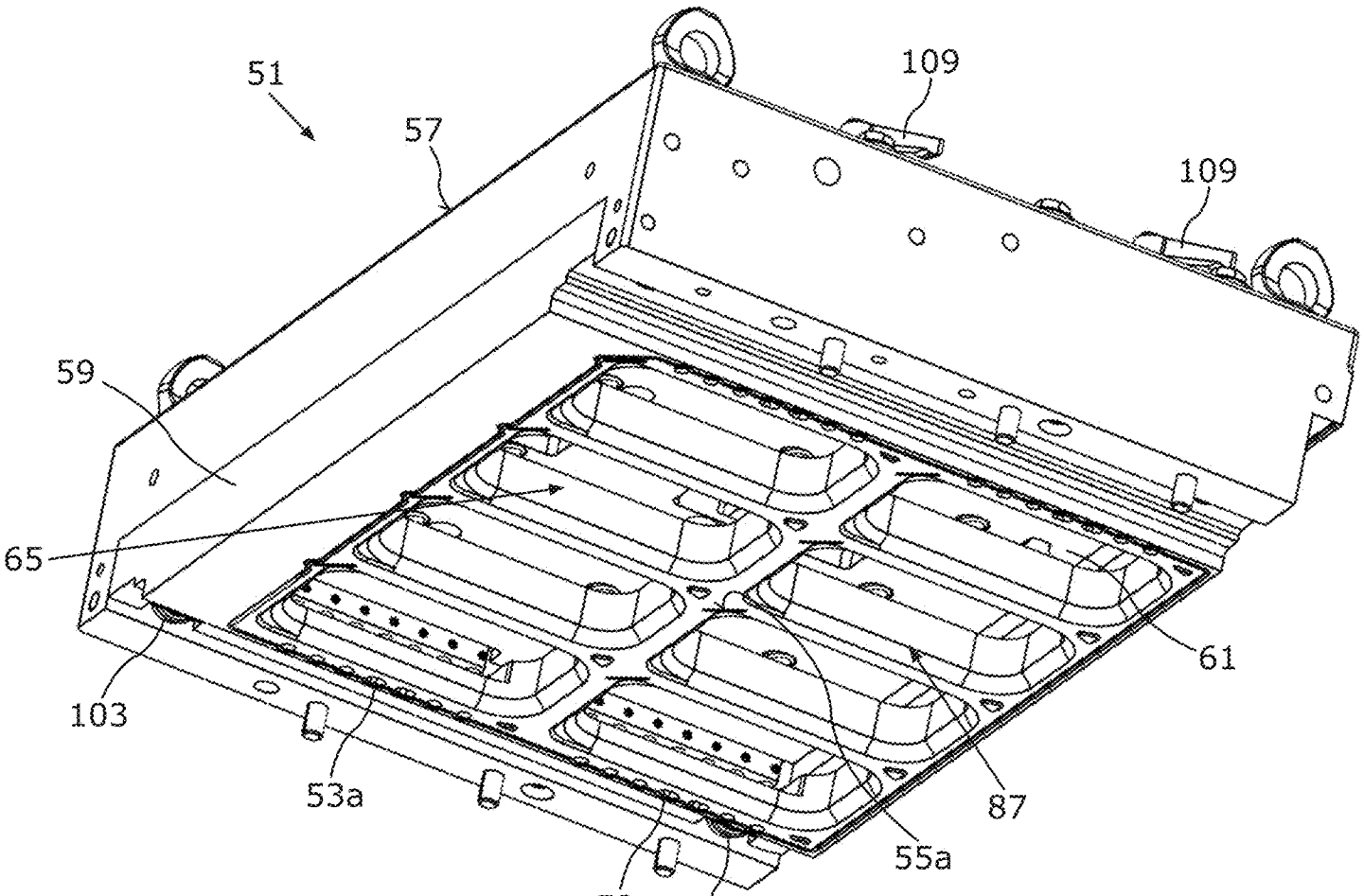

FIG. 7 shows a perspective view of the lower side of the separating unit 51 with the support frame 59 inserted into the base part 57. The lower side of the support frame 59 facing away from the base part 57 defines the already mentioned separating plane S in which the material web 23 extends when the station is closed. Thus, the material web 23 then lies between the openings 87 of the support frame 59 and the negative molds of the counter-unit 85 (cf. FIG. 3). Consequently, in this state, the pressure space 65 between the separating plane S and the base part 67 is closed and is furthermore sealed with respect to the environment by means of the seal 69 mentioned (cf. FIG. 5).

During the operation of the packaging machine, the separating unit 51 is connected to a compressed air source so that the pressure space 65 can be pressurized in order to drive the material web 23 into the negative molds 83 of the counter-unit 85 and thus to form the desired recesses 29 (cf. FIG. 1) in the material web 23.

Figure 8:
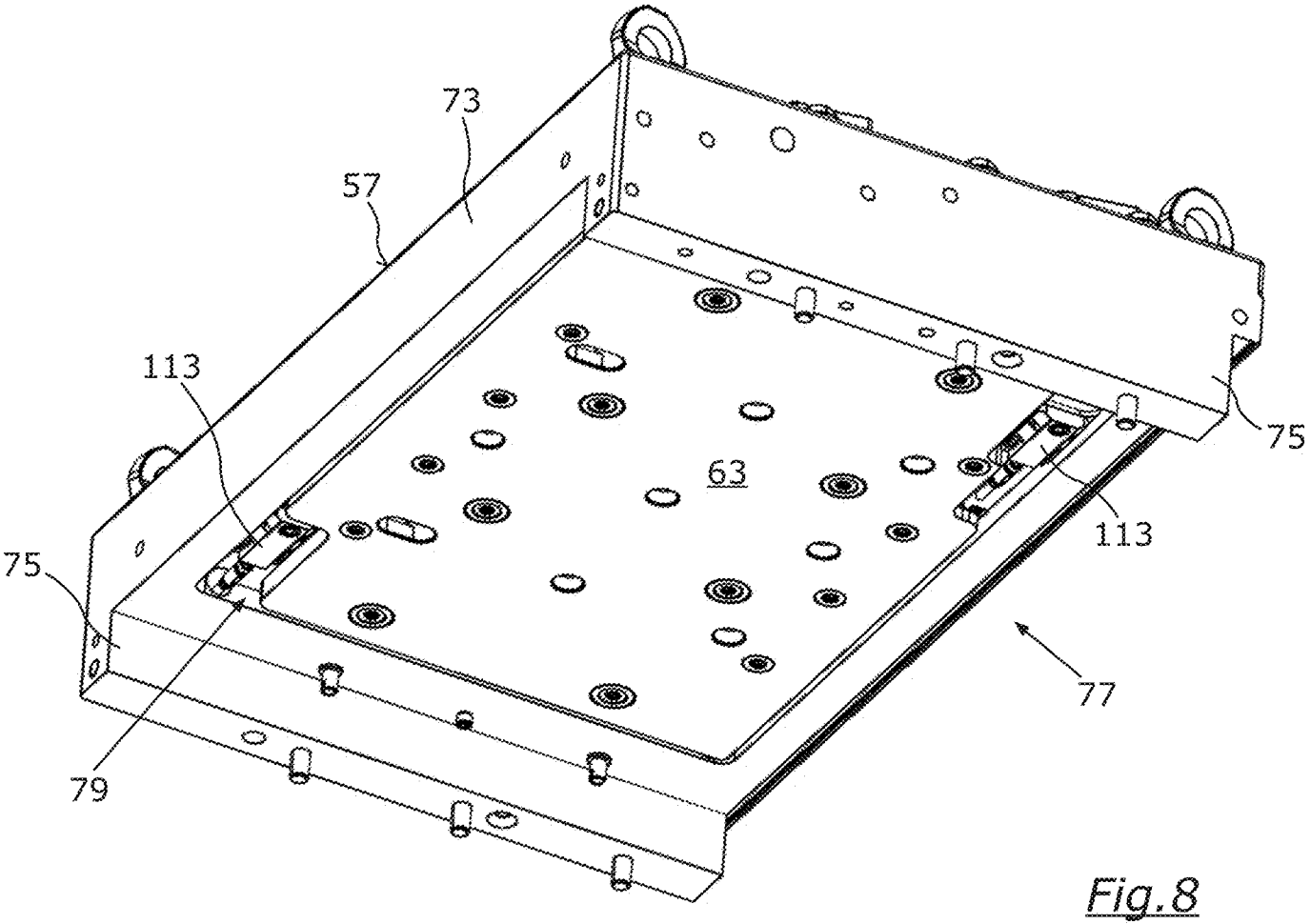

In this way, the separating unit 51 according to the invention contributes to the reshaping process for forming recesses 29 in the material web 23. For the further function of the separating unit 51, namely the processing of the material web 23 with the blades 53, 55 for producing the perforations and peel corner cuts in the material web 23, a drive for the holding plates 61, which are provided with the blades 53, 55 and are movably supported in the support frame 59 in the manner described above, is integrated into the base part 87. This drive comprises a pressure plate 63 (cf. FIGS. 8 and 9) that, in the passive state according to FIG. 8, is located in a recess 79 that is formed at the inner side of the end plate 73 of the base part 57. Thus, the pressure plate 63 is located above the receiving space 77 for the support frame 59 not shown in FIG. 8.

Figure 9:
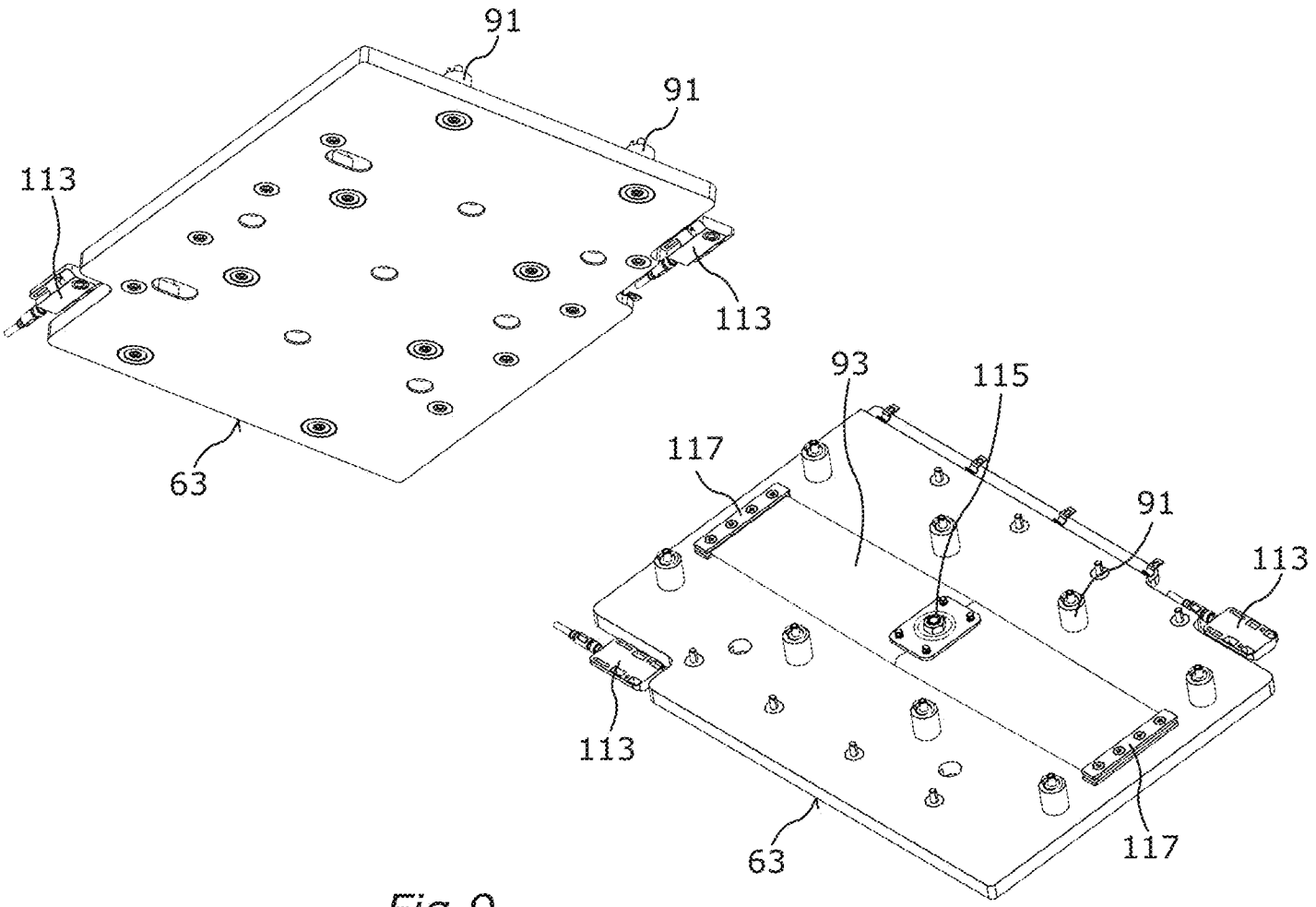

Proximity switches 113, which can be fastened to the base part 57 or the pressure plate 63, are likewise shown in FIGS. 8 and 9. The proximity switches 113 are connected to the central control device 41 of the packaging machine (cf. FIG. 1) and are configured to detect whether the support frame 59 is inserted into the receiving space 77, or not, in order to provide a corresponding signal for the control device 41. It can hereby be ensured by means of the control device 41, for example, that the packaging machine can only be put into operation when an intended support frame 59 is inserted into the base part 57, i.e. when the separating unit 51 is complete and ready for use.

As FIG. 9 shows in the right-hand representation, the pressure plate 63 is provided with a flexible hollow body 93, here in the form of a hose, at its upper side facing the inner side of the end plate 73 of the base part 57. At both of its end regions, the hollow body 93 is fastened to the upper side of the pressure plate 63 by means of holders 117. At the center, the hollow body 93 is connected to a compressed air port 115 via which the hollow body 93 can be acted on by compressed air and can thus be inflated to move the pressure plate 63 in the working direction W (cf. FIG. 3) and thus to move the holding plates 61 relative to the support frame 59 fixedly connected to the base part 57.

The activation of the pressure plate 63 by inflating the hollow body 93 thus means the triggering of a separating process that comprises the blades 53, 55 attached to the holding plate 61 being extended out of the apertures 53*a*, 55*a* (cf. FIG. 7) of the support frame 59 when the holding plate 61 is pressurized. During the extension, the blades 53, 55 pierce the separating plane S and thus the material web 23 extending there so that, with this separating process, the perforations are made in the material web 23 by means of the circular blades 53 and the peel corner cuts are made by means of the straight blades 55.

The pressure plate 63 is attached via spring arrangements 91 to the inner side of the end plate 73 of the base part 57 such that the downward movement of the pressure plate 63 takes place when inflating the hollow body 93 against the return force of compression springs of the spring arrangements 91. When the application of compressed air to the hollow body 93 stops, the spring arrangements 91 consequently ensure the return movement of the pressure plate 63 back into the passive starting position within the recess 79 in the end plate 73 according to FIG. 8. For a resetting of the pressure plate 63, it is consequently not necessary to apply a negative pressure to the hollow body 93.

The holding plates 61 also experience a return movement due to the spring arrangements 89, explained above with reference to FIG. 5, between the end plate 81 of the support frame 59 and the holding plates 61. Consequently, when applying compressed air to the hollow body 93 of the pressure plate 63, work is carried out against the return forces of both the spring arrangements 89 and the spring arrangements 91.

Consequently, with the separating unit 51 according to the invention, two functions can be performed independently of one another in time, namely the reshaping of the material web 23 to form the recesses 29 (cf. FIG. 1), on the one hand, and the production of perforations and peel corner cuts, i.e. generally the processing of the material web by means of separating elements, on the other hand.

Both functions can be performed by means of compressed air. The point in time at which the separating process takes place can, depending on the respective application, be selected independently of the point in time of the closing of the station 12 and independently of the time sequence of the molding process.

As already mentioned in the introductory part, the separating process takes place as late as possible so that the material web 23 previously heated by means of the heating units 105 of the station 12 (cf. FIG. 2) has already cooled down again. The contact of the material web 23 with the lower side of the support frame 59 of the separating unit 51 and the upper side of the counter-unit 85 forming the lower molding tool causes this cooling. On the other hand, the separating process takes place at a point in time at which molding pressure is still built up within the mentioned pressure space 65 (cf. FIG. 7) of the separating unit 51 so that impurities can be blown out in the initially explained manner. This is in particular important if the material web has one or more fibrous material layers since so-called cutting dust, which should not enter the product regions 20 of the packages 21 to be produced, can arise when processing such material webs by means of the blades 53, 55.

One advantage of the separating unit 51 according to the invention, in particular with regard to the function of the reshaping of the material web 23, is that a comparatively high pressure can be built up within the pressure space 65. For example, an overpressure above atmospheric pressure can be built up that amounts to up to 5 bar, for example lies between 2 bar and 3 bar. Depending on the respective application, such a molding pressure makes it possible that the reshaping process can be performed without an additional application of negative pressure. This saves design effort and energy and has the further advantage that when using material webs comprising one or more fibrous material layers that are pretreated by increasing the moisture content, no unwanted vacuum drying of the fibrous material takes place.

As mentioned elsewhere, the application of negative pressure can be provided to remove processing residues such as in particular cutting dust. This suction can in particular take place coordinated in time such that suction only takes place when the station 12 is open again in order, in this way, to prevent an unwanted vacuum drying of the fibrous material.

With a view to a particularly easy removal of the support frame 59 and thus of the holding plates 61 when the support unit 51 is installed at the packaging machine, said support unit is designed such that, on the one hand, the support frame 59 is fixedly connected to the base part 57 and the pressure space 65 bounded by the support frame and the base part 57 is sealed with respect to the environment by means of the seal 69, and such that, on the other hand, the support frame 59 simultaneously rests on the packaging machine V via the rollers 103, in particular on running rails of the packaging machine V that are provided for this purpose and that extend in the transport direction T. Thus, the user only needs to loosen the fixing screws 109 by hand and then pull the support frame 59—like a drawer—out of the base part 57 of the separating unit, wherein the support frame 59 rolls on the running rails. The support frame 59 together with the holding plates 61 or one or more of the holding plates 61 can then e.g. be removed for cleaning purposes or can, for example, be replaced to convert the separating unit 51 to another application.

REFERENCE NUMERAL LIST

10 product
11 molding station
11*a* upper part of the molding station
11*b* lower part of the molding station
12 combined heating and molding station
13 insertion station
13*a* conveyor belt
13*b* conveyor belt
14 feed station
15 sealing station
15*a* upper part of the sealing station
15*b* lower part of the sealing station
16 labeling station
17 separating station (transverse direction)
19 separating station (longitudinal direction)
20 product region
21 package
23 bottom web
23*a* supply roll
25 top web
25*a* supply roll
27 transport device (transport chain for bottom web)
29 recess
41 control device
43 sealing seam
45 operating unit
47 machine frame
50 robot
51 separating unit
53 separating element, blade
55 separating element, blade
53*a* aperture
55*a* aperture
57 base part

59 support frame
61 holding plate
62 receiver
63 pressure plate
65 pressure space
67 groove for seal
69 seal
71 recess of the support frame
73 end plate of the base part
75 side wall of the base part
77 receiving space of the base part
79 recess of the end plate
81 end plate of the support frame
83 negative mold of the counter-unit
85 counter-unit, lower molding tool
87 opening of the support frame
89 spring arrangement of the support frame
91 spring arrangement of the pressure plate
93 inflatable hollow body
97 cut-out in the counter-unit
99 escape and/or suction opening
101 lower part
103 rolling member
105 heating unit
107 upper part
109 fixing screws
111 holder
113 proximity switch
115 compressed air port
117 holder
V packaging machine
T transport direction
S separating plane
W working direction
B working width

The invention claimed is:

1. A separating unit for a packaging machine for packaging food products, wherein the separating unit is configured to process a material web, which is moved in the packaging machine along a transport direction, by a plurality of separating elements of a same type or of different types, wherein the separating unit defines:

a separating plane that is in parallel with the material web during operation, a working direction perpendicular to the separating plane, and a working width that is in parallel with the separating plane and perpendicular to the transport direction and that corresponds to the width of a respective material web, and wherein the separating unit comprises a plurality of separate assemblies, that are arranged above one another in the working direction, the plurality of separate assemblies including:

a base part;

a support frame that is fastened to the base part and having a first side facing away from the base part the separating plane is disposed;

at least one holding plate between the base part and the support frame that is movably supported at or in the support frame in the working direction and having a second side facing away from the base part with at least one separating element projecting in the working direction is attached, wherein the support frame is provided with apertures for the plurality of separating elements; and at least one pressure plate between the at least one holding plate and the base part that acts as a drive for the at least one holding plate, wherein the at least one pressure plate can be acted on by compressed air connectable to the separating unit, and wherein the at least one pressure plate is configured to adjust the at least one holding plate between a passive position with at least one of the plurality of separating elements retracted into the apertures of the support frame and an active position with at least one of the plurality of separating elements extended out of the apertures and through the separating plane.

2. A separating unit according to claim 1, wherein the separating unit is connectable to a compressed air supply and a molding pressure can be built up in a pressure space, which is bounded by the base part and the support frame, by supplied compressed air when, during operation, the support frame, with its side facing away from the base part, contacts the material web to form recesses in the material web by reshaping the material web by the molding pressure.

3. A separating unit according to claim 2, wherein the pressure space is sealed with respect to the environment by a seal arranged between the base part and the support frame.

4. A separating unit according to claim 2, wherein the at least one pressure plate and the at least one holding plate are arranged within the pressure space.

5. A separating unit according to claim 1, wherein the at least one holding plate comprises a plurality of separate holding plates, each comprising one separating element or the plurality of separating elements, are movably supported at or in the support frame.

6. A separating unit according to claim 5, wherein the plurality of separate holding plates are configured to be assembled to form a total plate and are jointly movably supported at or in the support frame.

7. A separating unit according to claim 5, wherein the plurality of separate holding plates is jointly adjustable by the at least one pressure plate.

8. A separating unit according to claim 5, wherein a first holding plate of the plurality of separate holding plates has one or more separating elements of a first type and a second holding plate of the plurality of separate holding plates has one or more separating elements of a second type, wherein the first type and the second type are the same or different.

9. A separating unit according to claim 5, wherein at least one separate holding plate of the plurality of separate holding plates is configured as a holder for at least one other separate holding plate.

10. A separating unit according to claim 9, wherein the at least one separate holding plate fills the support frame in a plane in parallel with the separating plane and is provided with a receiver for the at least one other separate holding plate.

11. A separating unit according to claim 1, wherein the base part, the support frame, the at least one holding plate and the at least one pressure plate each extend across the working width.

12. A separating unit according to claim 11, wherein the base part, the support frame, the at least one holding plate, and the at least one pressure plate each have a smaller construction height in the working direction compared to the working width.

13. A separating unit according to claim 1, wherein the base part has an end plate comprising two side walls spaced apart from one another in the direction of the working width and projecting towards the separating plane in the working direction, wherein the side of the end plate facing towards the separating plane and the two side walls bound a receiving space for the support frame.

14. A separating unit according to claim 13, wherein the support frame is configured to be inserted into the receiving space of the base part.

15. A separating unit according to claim 13, wherein the end plate of the base part has, at a third side facing towards the separating plane, a recess for receiving the at least one pressure plate.

16. A separating unit according to claim 1, wherein the support frame has, at a third side facing towards the base part, a recess for receiving the at least one holding plate and an end plate in which the apertures for the plurality of separating elements of the at least one holding plate are formed.

17. A separating unit according to claim 1, wherein a total construction height of the separating unit in an assembled state is less than a sum of individual construction heights of the base part and the support frame.

18. A separating unit according to claim 1, wherein the at least one holding plate and/or the support frame is/are provided with one or more spring arrangements against whose return force the at least one holding plate is adjustable into the active position by the at least one pressure plate and by which the at least one holding plate is preloaded into the passive position.

19. A separating unit according to claim 1, wherein the at least one pressure plate and/or the base part is/are provided with one or more spring arrangements against whose return force the at least one pressure plate, when acted on by the compressed air, is moved away from the base part in order to adjust the at least one holding plate into the active position.

20. A separating unit according to claim 1, wherein the at least one pressure plate, at a side thereof that faces the base part, is provided with at least one flexible hollow body connectable to a compressed air supply and that is inflatable by applying the compressed air.

21. A separating unit according to claim 1, wherein a set of different support frames that are mutually interchangeable at the base part is provided and/or a set of different holding plates that are mutually interchangeable at the support frame or that can be used with different support frames is provided.

22. A separating unit according to claim 1, wherein the material web comprises at least one fibrous material layer that comprises or consists of fibrous material.

23. A station for a packaging machine for packaging food products, said station comprising at least one separating unit according to claim 1 and a counter-unit that, during operation, is arranged at another side of the material web to be processed opposite the separating unit, wherein the separating unit and the counter-unit are movable relative to one another perpendicular to the separating plane in order to perform working strokes for closing and opening the station, and adjustment movements of the at least one holding plate of the separating unit that are affected by the at least one pressure plate are performed in addition to the working strokes.

24. A station according to claim 23, wherein, during operation, the separating unit is arranged above the separating plane and the counter-unit is arranged below the separating plane.

25. A station according to claim 23, wherein the station is a molding station or a combined heating and molding station that is configured to form recesses in the material web by reshaping the material web, wherein the counter-unit comprises a plurality of negative molds and the support frame comprises openings corresponding to the plurality of negative molds, wherein, when the station is closed, a molding pressure can be built up in the separating unit, at a side of the separating plane facing the base part, by compressed air to drive the material web into the plurality of negative molds and thus to form the recesses, and wherein, during or after completion of a build-up of the molding pressure, the at least one holding plate of the separating unit can be adjusted into the active position to process the material web by the plurality of separating elements.

26. A station according to claim 23, wherein the station is a heating station or a combined heating and molding station, and wherein the counter-unit is a heating unit that is configured to heat the material web.

27. A station according to claim 23, wherein the counter-unit is provided with cut-outs that correspond to the plurality of separating elements of the separating unit and that are configured to receive the plurality of separating elements that are extended out of the apertures and through the separating plane.

28. A station according to claim 27, wherein at least some cut-outs are provided with escape and/or suction openings via which compressed air can escape after the processing of the material web has taken place and/or which can be acted on by negative pressure.

29. A station according to claim 23, wherein the material web comprises at least one fibrous material layer that comprises or consists of fibrous material.

30. A packaging machine for packaging food products comprising at least one station according to claim 23.

31. A packaging machine according to claim 30, wherein the support frame together with the at least one holding plate is removable from the separating unit with the base part remaining at the packaging machine.

32. A packaging machine according to claim 30, wherein the support frame is supported on the packaging machine.

33. A packaging machine according to claim 32, wherein the support frame is supported on the packaging machine via one or more sliding or rolling members.

34. A packaging machine according to claim 30, wherein the material web comprises at least one fibrous material layer that comprises or consists of fibrous material.

35. A packaging machine according to claim 34, further comprising a pretreatment device that is configured to subject the material web to a pretreatment in which a moisture content of the at least one fibrous material layer is changed.

36. A molding station for a packaging machine for packaging food products, said molding station comprising a separating unit according to claim 1.

37. A molding station according to claim 36, wherein the station is a combined heating and molding station that is configured to form recesses in the material web by reshaping the material web.

38. A molding station according to claim 37, wherein the molding station is configured for a reshaping without heat or for a reshaping by thermoforming.

39. A molding station according to claim 38, wherein the molding station is configured to perform the reshaping of the material web by compressed air forming, by vacuum forming, by a combined compressed air and vacuum forming or by die forming.

40. A molding station according to claim 36, wherein the separating unit is a component of an upper part or of a lower part of the molding station, or wherein the separating unit forms the upper part or the lower part of the molding station.

41. A molding station according to claim 40, wherein the separating unit is configured as a tool or as a part of an overall tool for reshaping the material web.

42. A molding station according to claim 41, wherein a reshaping of the material web takes place by compressed air forming, by vacuum forming, by a combined compressed air and vacuum forming or by die forming.

43. A molding station according to claim 36, wherein the separating unit forming a component of an upper part or a lower part of the molding station or the separating unit forming the upper part or the lower part of the molding station comprises a base that is stationary with respect to the working direction during operation and the plurality of separating elements can be adjusted relative to the base between the passive position and the active position in order to process the material web.

* * * * *